US006258318B1

(12) United States Patent
Lenczowski et al.

(10) Patent No.: US 6,258,318 B1
(45) Date of Patent: Jul. 10, 2001

(54) WELDABLE, CORROSION-RESISTANT AIMG ALLOYS, ESPECIALLY FOR MANUFACTURING MEANS OF TRANSPORTATION

(75) Inventors: Blanka Lenczowski, Neubiberg; Rainer Rauh, Jetzendorf; Dietrich Wieser, Bonn; Gerhard Tempus, Bremen, all of (DE)

(73) Assignee: EADS Deutschland GmbH, Munich (DE)

( * ) Notice: Subject to any disclaimer, the term of this patent is extended or adjusted under 35 U.S.C. 154(b) by 0 days.

(21) Appl. No.: 09/530,068

(22) PCT Filed: Aug. 14, 1999

(86) PCT No.: PCT/DE99/02549

§ 371 Date: Jun. 14, 2000

§ 102(e) Date: Jun. 14, 2000

(87) PCT Pub. No.: WO00/11229

PCT Pub. Date: Mar. 2, 2000

(30) Foreign Application Priority Data

Aug. 21, 1998 (DE) ..... 198 38 017

(51) Int. Cl.[7] ..... C22C 21/06
(52) U.S. Cl. ..... 420/542; 420/543
(58) Field of Search ..... 420/542, 543

(56) References Cited

U.S. PATENT DOCUMENTS

| | | | |
|---|---|---|---|
| 4,645,543 | 2/1987 | Watanabe et al. | 148/2 |
| 5,624,632 | 4/1997 | Baumann et al. | 420/544 |

FOREIGN PATENT DOCUMENTS

| | | |
|---|---|---|
| 0918095 | 10/1993 | (EP) . |
| 0563903 | 5/1999 | (EP) . |
| 2717827 | 9/1995 | (FR) . |
| 63-179040 | 7/1988 | (JP) . |

OTHER PUBLICATIONS

Patent Abstracts of Japan of JP 63–179040 Dated: Jul. 23, 1998.
Brockhaus der Naturwissenschaften und der Technik, p. 161 (1965) F.A. Brockhaus Wiesbaden.
Gschneider, Jr., K.A. "A critical Review of the Alloy Systems of the Rare Earth, Scandium and Yttrium Metals," in Rare Earth Alloys (1961) pp. XI & 12.
Filatov Y. A. "Weldable Aluminum –Magnesium–Scandium System Base Alloys" Welding in the World, Bd. 33, Nr. 6, (1994).
Database WPI Derwent Publications Ltd. XP002130336 & JP 52 011143 (Nippon Light Metal Res Lab) Jan. 27, (1977–01–27).

*Primary Examiner*—George Wyszomierski
*Assistant Examiner*—Janelle Combs-Morillo
(74) *Attorney, Agent, or Firm*—Ladas & Parry

(57) ABSTRACT

A weldable, corrosion resistant aluminum-magnesium alloy consisting essentially of 3 to 5% by weight magnesium (Mg), 0.05 to 0.15% by weight zirconium (Zr), 0.05 to 0.12% by weight manganese (Mn), 0.01 to 0.2% by weight titanium (Ti), 0.05 to 0.5% by weight of one or more elements selected from the scandium group of the Periodic Table and/or terbium (Tb), wherein at least 0.15% by weight scandium (Sc) is included with or without terbium (Tb) and with or without 0.05 to 0.35% by weight of one or more elements from the lanthanide series, the balance being aluminum (Al), and unavoidable contaminants not exceeding 0.2% by weight silicon (Si).

7 Claims, No Drawings

WELDABLE, CORROSION-RESISTANT AIMG ALLOYS, ESPECIALLY FOR MANUFACTURING MEANS OF TRANSPORTATION

BACKGROUND OF THE INVENTION

The invention relates to a weldable, corrosion-resistant, high-magnesium content aluminum-magnesium alloy, which contains a ternary aluminum-scandium-zirconium phase as an essential component. Such an alloy is disclosed in U.S. Pat. No. 5,624,632, for application in aerospace construction due to its low density, high strength and corrosion resistance. Adding rare earth or rare earth-like elements generates dispersoids in the aluminum-magnesium alloy, which produce a higher strength and corrosion resistance. The aforesaid U.S. patent is silent as regards the weldability of such an alloy.

SUMMARY OF THE INVENTION

An object of this invention is to provide a weldable, corrosion-resistant, high magnesium content aluminum-magnesium alloy, which is at least as good as the known alloy with respect to strength and corrosion resistance and exhibits a high recrystalization threshold and good weldability. This and further objects of the invention are achieved by a weldable, high magnesium-content aluminum-magnesium alloy consisting essentially of 3 to 5% by weight magnesium, 0.05 to 0.15% by weight zirconium, 0.05 to 0.12% by weight manganese, 0.01 to 0.2% by weight titanium, 0.05 to 0.5% by weight of at least one element selected from the scandium group of the Periodic Table, wherein scandium is present as a mandatory element optionally with terbium and/or 0.05% to 0.35% by weight of one or more elements in the lanthanide series, the balance being aluminum and unavoidable contaminants not exceeding 0.2% by weight silicon.

DETAILED DESCRIPTION

In comparison with the above described known alloy, in U.S. Pat. No. 5,624,632 the new alloy of the invention exhibits primarily a distinctly lower manganese content, whereby an improved corrosion resistance was surprisingly obtained, especially in a heat-treated state of parts made from this alloy, e.g., when cold-formed parts are subjected to an elevated temperature over a prolonged period of time. It was found that these positive properties are determined by the ratio of manganese to scandium. An improved corrosion resistance is found when the ratio of Mn to Sc is less than 2. Along with acting as a grain growth inhibitor, the titanium content (not present in the described known alloy) helps to increase strength, since titanium can replace the zirconium in the ternary Al—Sc—Zr phase, wherein the solubility of titanium is lower than that of zirconium, however.

It has also been found that scandium can be replaced by terbium, at least within certain limits. However, more terbium than the amount of scandium being replaced must be added to achieve constant properties.

A particularly favorable alloy for motor vehicles ships and aircraft structures contains at least 0.15% by weight scandium. One of more elements from the Lanthanide series is preferably included in amounts ranging from 0.05 to 0.35% by weight. The alloy tolerates silicon contamination of up to 0.2% by weight, the dynamic properties of the alloy deteriorating above this level.

Although the invention is disclosed with reference to particular compositions, it will become apparent to those skilled in the art that numerous modifications and variations can be made which will fall within the scope and spirit of the invention as defined by the attached claims.

What is claimed is:

1. A weldable, aluminum-magnesium alloy comprising a ternary aluminum-scandium-zirconium phase and consisting essentially of 3 to 5% weight magnesium, 0.05 to 0.15% by weight zirconium, 0.05 to 0.12% by weight manganese, 0.01 to 0.2% by weight titanium, 0.05 to 0.5% by weight of at least one element from the group consisting of scandium and the lanthanide series, wherein at least scandium is present, the balance being aluminum, and unavoidable contaminants not exceeding 0.2% by weight silicon.

2. An aluminum-magnesium alloy as claimed in claim 1, wherein the ratio of manganese to scandium is less than 2.

3. An aluminum-magnesium alloy as claimed in claim 1, wherein at least 0.15% by weight of scandium is present in the alloy.

4. An aluminum-magnesium alloy as claimed in claim 1, wherein said at least one element from said group in addition to scandium comprises terbium.

5. An aluminum-magnesium alloy as claimed in claim 1, wherein said at least one element from the said group in addition to scandium is 0.05 to 0.35% by weight of an element in the lanthanide series.

6. An aluminum-magnesium alloy as claimed in claim 5, wherein said at least one element in the lanthanide series is neodyme, europium, gadolinium, dysprosium, holmium or erbium.

7. Rolled, extruded, welded or forged component of an aircraft, a ship or a motor vehicle consisting of an AlMg alloy according to claim 1.

* * * * *

UNITED STATES PATENT AND TRADEMARK OFFICE

CERTIFICATE OF CORRECTION

PATENT NO. : 6,258,318 B1
DATED : July 10, 2001
INVENTOR(S) : Blanka Lenczowski et al.

It is certified that error appears in the above-identified patent and that said Letters Patent is hereby corrected as shown below:

Title page, Item [54] and Column 1, line 2,
"AIMG" should read -- ALMG --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,258,318 B1
DATED : July 10, 2001
INVENTOR(S) : Blanka Lenczowski et al.

It is certified that error appears in the above-identified patent and that said Letters Patent is hereby corrected as shown below:

Title page,
Item [73], Assignee, after "(DE)" insert -- Vaw Aluminium AG, Bonn (DE) --.

Signed and Sealed this

Sixth Day of June, 2006

JON W. DUDAS
*Director of the United States Patent and Trademark Office*